US007251976B2

(12) United States Patent
Field et al.

(10) Patent No.: US 7,251,976 B2
(45) Date of Patent: Aug. 7, 2007

(54) APPARATUS AND METHOD FOR THE NONCIRCULAR BENDING OF TUBES

(75) Inventors: David A. Field, Birmingham, MI (US); Charles W. Wampler, II, Birmingham, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 291 days.

(21) Appl. No.: 11/069,173

(22) Filed: Mar. 1, 2005

(65) Prior Publication Data

US 2005/0145002 A1 Jul. 7, 2005

Related U.S. Application Data

(63) Continuation-in-part of application No. 10/611,842, filed on Jul. 1, 2003.

(51) Int. Cl.
*B21D 7/04* (2006.01)

(52) U.S. Cl. ..... 72/149; 72/146; 72/157; 72/369

(58) Field of Classification Search ..... 72/149–150, 72/214–219, 467, 369
See application file for complete search history.

(56) References Cited

U.S. PATENT DOCUMENTS 1,662,428 A * 3/1928 Lowe ..... 72/150
1,714,083 A * 5/1929 Louis ..... 72/153
1,731,087 A * 10/1929 Zatti ..... 72/155
2,474,276 A * 6/1949 Payne ..... 72/152
4,090,387 A * 5/1978 Dubreuil ..... 72/217
4,416,136 A * 11/1983 Schwarze ..... 72/157
4,727,738 A * 3/1988 Yogo ..... 72/157
4,843,858 A * 7/1989 Grimm et al. ..... 72/149
5,127,248 A * 7/1992 Sanseau et al. ..... 72/149
5,463,888 A * 11/1995 Nagai ..... 72/157
5,937,687 A * 8/1999 Bhandari et al. ..... 72/155
6,976,378 B2 * 12/2005 Kobayashi ..... 72/149

* cited by examiner

*Primary Examiner*—Dmitry Suhol

(57) ABSTRACT

A tube bending apparatus adapted for the noncircular bending of a tube includes a modified bend die, a modified wiper die, a translatable and pivotable element and an actuator. The bend die presents a noncircular bending profile having a linearly or nonlinearly increasing radius of curvature. The wiper die is configured to accommodate the maximum radius presented by the profile, and the element and actuator present an inclined rack and pinion configuration. The bend die presents an involute of a circle having a radius equal to the product of the radius of the pinion and the sine of the angle of inclination, so that the bend die engages the tube at a fixed point in space during bending.

11 Claims, 3 Drawing Sheets

APPARATUS AND METHOD FOR THE NONCIRCULAR BENDING OF TUBES

CROSS REFERENCES

The present application is a continuation-in-part and claims priority benefit with regard to all common subject matter of an earlier-filed pending U.S. patent application entitled "VARIABLE CURVATURE TUBE AND DRAW DIE THEREFOR," Ser. No. 10/611,842, filed Jul. 1, 2003. The identified earlier-filed pending application is hereby incorporated by reference into the present application.

BACKGROUND OF THE INVENTION

1. Field of the Invention

The present invention relates to tube bending apparatuses, and more particularly to an improved die and tube bending apparatus configured to produce noncircular bends in tubes.

2. Discussion of Prior Art

Conventional tube-bending apparatuses primarily employ compression, press and rotary draw methods to bend tubes along circular arcs. These apparatuses and methods are commonly utilized in various industries, including automobile and aircraft assembly, plumbing and fire protection, and equipment/conduit manufacture. These apparatuses typically include a set of dies and a drive mechanism that cooperate to impart pressure upon the tube, so that the tube bends to a predetermined form. More particularly, a bend die is positioned adjacent to a section of the tube and the apparatus is configured to conform the section to the circular profile defined by the bend die. The engaging surface of the bend die is-formed by a constant radius, and therefore produces a change in radius at the beginning of the bend equal to the difference between the constant radius and the radius of the virtually straight tube prior to the bend. Once released, a minor degree of spring-back occurs to result in the final orientation of the bent tube.

These conventional apparatuses and methods, however, present a plurality of concerns to those ordinarily skilled in the art, as well as the targeted consumer. Of primary concern, is deformation that frequently occurs during the bending process. During these deformed bends, the tube collapses on the outer side, and compresses on the inner side of the tube to produce flat or concave spots and wrinkles respectively; and the likelihood of deformation is based in part on the outer tube diameter, wall thickness, and radius of curvature of the bend. These deformed bends may result in increased costs and inconvenience, both during the fabrication and utilization of the tube. For example, where a mandrel is initially inserted into the tube to facilitate bending, a small degree of deformation may inhibit the removal of the mandrel, and thereby result in inefficiencies to the overall fabrication process, where the tube is utilized as a conduit, the reduced cross sectional area of the deformed bend results in a decreased capacity of flow, and finally, where the bent tube is utilized proximate an operator/end user, as in a bicycle frame, the wrinkles may result in abrasions to the operator or damage to fabric coming in contact therewith.

Even where properly formed, conventionally bent tubes present concerns. During the network installation of a bent tube, for example, the lack of geometric flexibility in the configuration of the produced bends limits the efficient use of space. This can be seen in the congested space of the undercarriage of an automobile, where the limitations to circular and combinations of circular bends of exhaust tubing often limit design configurations. Where utilized as a conduit, the abrupt change in radius caused by conventional apparatuses and methods also results in a greater dissipation of fluid energy.

Accordingly, there is a need in the art for an improved apparatus for and method of bending tubes that reduces the likelihood of deformation and provides greater geometric flexibility during installation.

BRIEF SUMMARY OF THE INVENTION

Responsive to these and other concerns caused by conventional tube benders, the present invention concerns an apparatus for and method of noncircularly bending a tube. Among other things, the invention provided hereof, is useful for reducing the likelihood of deformed bends, and providing additional choices of geometric configuration of bends during installation.

A first aspect of the present invention concerns an apparatus adapted for the noncircular bending of a tube. The apparatus includes a holding element engaging a first section of the tube, and a bending element configured to apply a bending force to a second section of the tube. The bending and holding elements are cooperatively configured to retain the first section in a fixed position relative to the bending and holding elements, and to bend the second section into a final condition, wherein the second section presents a noncircular bend having a gradually increasing radius of curvature. The bending element includes a bending die having a tube-engaging surface, wherein the surface presents a longitudinal cross section having a noncircular circumferential profile. The bending element is further configured to compress the second section of the tube against the surface, so as to conform the second section to the noncircular profile of the surface. The bending element includes a rotatable spur gear removably connected to the die, and a driven gear rack interconnected with the gear and configured to cause the rotation and linear displacement of the gear and die relative to the rack. The gear has a radius equal to R, and the gear rack presents a lead incline edge that defines an angle $\Phi$ and a vertex with respect to horizontal. The rack is pivotable about the vertex so as to adjust the angle $\Phi$, and the profile defines an involute of a circle concentrically aligned with the gear and presenting a radius equal to $R \sin \Phi$, so that the die engages the tube at a fixed point during bending.

A second aspect of the present invention concerns a die adapted for interconnecting to an apparatus, wherein the die and apparatus are cooperatively configured to bend a tube. The die includes a tube-engaging surface having a holding portion and a bending portion. The bending portion presents first and second longitudinal ends, and a longitudinal cross section having a noncircular circumferential profile. The surface is configured to engage the apparatus during bending, so that a first section of the tube is held in a fixed position relative to the die adjacent to the holding portion and a second section of the tube conforms to the profile adjacent to the bending portion.

A third aspect of the present invention concerns a method for noncircularly bending a tube, wherein the tube presents first and second sections and a bending strength. The method includes the steps of applying a vector force component greater than the bending strength to the first section, and securing a tube-engaging surface adjacent to the first section and opposite the vector force direction, wherein the surface presents a longitudinal cross section having a noncircular circumferential profile and the profile presents a linearly increasing radius of curvature.

It will be understood and appreciated that the present invention provides a number of advantages over the prior art, including, for example, providing an apparatus for and method of noncircularly bending a tube. This invention decreases the likelihood of deformation during bending by gradually decreasing the radius of curvature. The present invention also provides more flexibility in design consideration.

Other aspects and advantages of the present invention will be apparent from the following detailed description of the preferred embodiment(s) and the accompanying drawing figures.

BRIEF DESCRIPTION OF THE SEVERAL VIEWS OF THE DRAWING

A preferred embodiment(s) of the invention is described in detail below with reference to the attached drawing figures, wherein.

DETAILED DESCRIPTION OF THE INVENTION

Figure 1A:
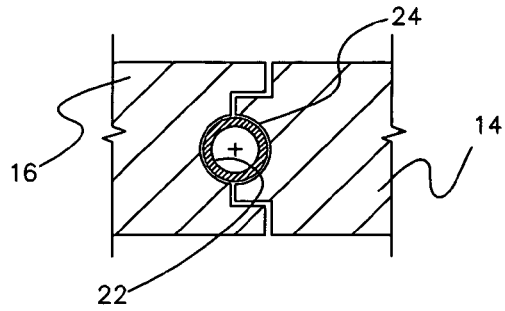
FIG. 1a (Prior Art)
FIG. 1*a* is a cross sectional elevation view of the tube, bend die, and clamp die shown in FIG. 1, particularly illustrating a reverse interlock configuration.
Figure 2:
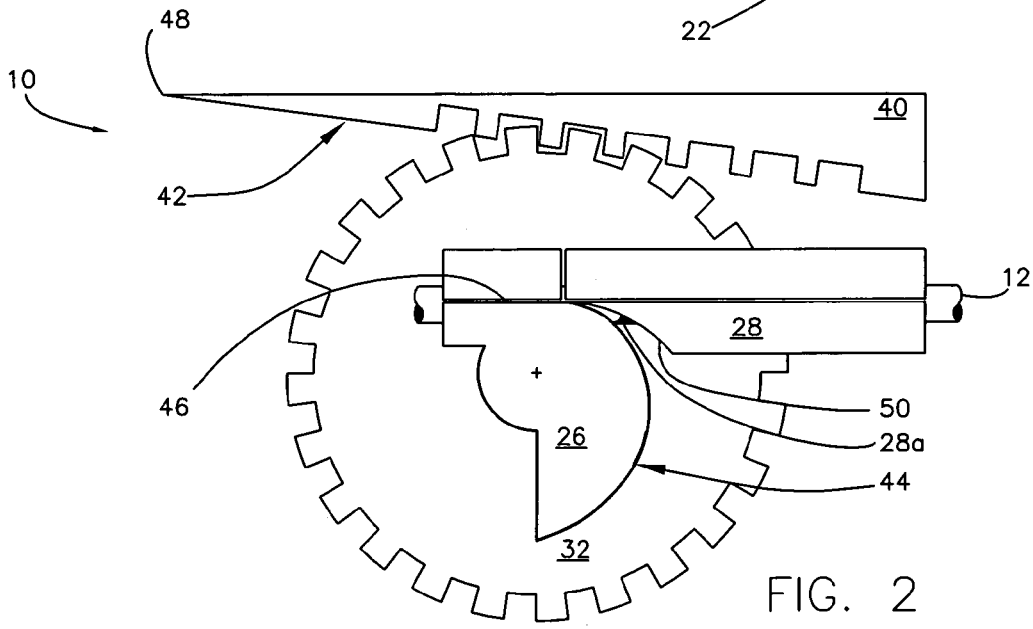
FIG. 2 is a plan view of a preferred embodiment of a noncircularly bending rotary draw bender in accordance with the present invention, and a tube in an unbent condition.

As shown FIG. 2, the present invention concerns a bending apparatus 10 configured to noncircularly bend a tube (or pipe) 12. The apparatus 10 is described and illustrated herein, with respect to rotary draw bending; however, it is well within the ambit of the present invention to utilize certain improvements and inventive aspects of the apparatus 10 in conjunction with other conventional tube-bending methods, such as compression, and press bending. As described herein, the tube 12 is formed by a longitudinal tube wall that presents a round cross sectional configuration and defines an outer diameter (o.d.), inner diameter (i.d.) and corresponding tube wall thickness, W. The preferred tube 12 presents a hollow cylindrical object having first and second open ends linearly separated by a tube length, inner and outer surfaces 22,24 and a longitudinal axis (See, FIG. 1*a*). The tube 12 may consist of any material of suitable strength to prevent deformation under normal operating conditions, including aluminum, stainless steel, copper (Type K and L), poly-butyrene (PB), etc. Finally, it is appreciated by those ordinarily skilled in the art that the tube may function structurally or as a conduit. However, it is certainly within the ambit of the invention for the apparatus 10 to be utilized and/or modified to bend other conventional members, such as square tubing, finned tubing, pipe, flat stock, Chromolly, solid rod, etc.

Figure 1:
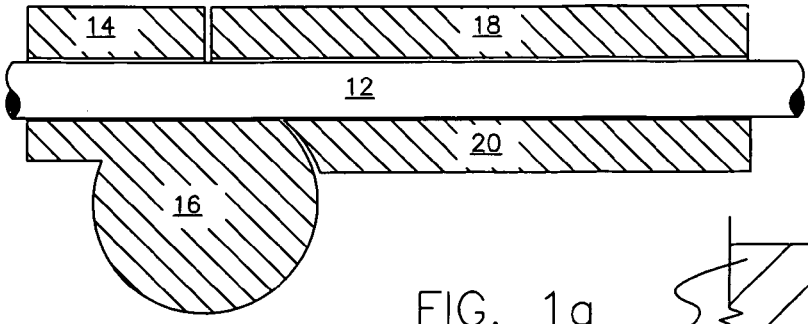
FIG. 1 (Prior Art)
FIG. 1 is a cross sectional plan view of a conventional rotary draw bending system and tube in an unbent condition.

The die components of a conventional rotary draw bender are shown in FIG. 1, and typically include a clamp die 14, a bend die (or draw die) 16, a pressure die (or follower die) 18, and a wiper die 20. These dies may be configured to form an interlocked position, such as the reversed interlocked position shown in FIG. 1*a*, so as to deter slippage or misalignment during bending.

An actuator (not shown) is communicatively coupled to the bend die 16, and configured to apply the bending force to the tube 12. The actuator may be driven by any of a plurality of conventional means, including manual, mechanically assisted manual, electrical, hydraulic, and electro-hydraulic drive systems to effect the rotary function of the bender. The rotary function of a conventional rotary draw bender is to move the bend die so that the point at which bending takes place is stationary and the die lies tangential to the incoming line of the tube. To achieve this intended function the actuator need only rotate the conventional circular die.

Turning to the configuration of the illustrated embodiment of the present invention, FIG. 2 shows a preferred rotary draw bender 10 having a modified bend die 26, modified wiper die 28, support structure 30 (see, FIG. 4), and a pivotable element 32. The apparatus 10 includes other components of a conventional rotary draw bender, such as the previously described pressure and clamp dies, that will not be further described herein with the understanding that the other components are conventionally configured.

Figure 3:
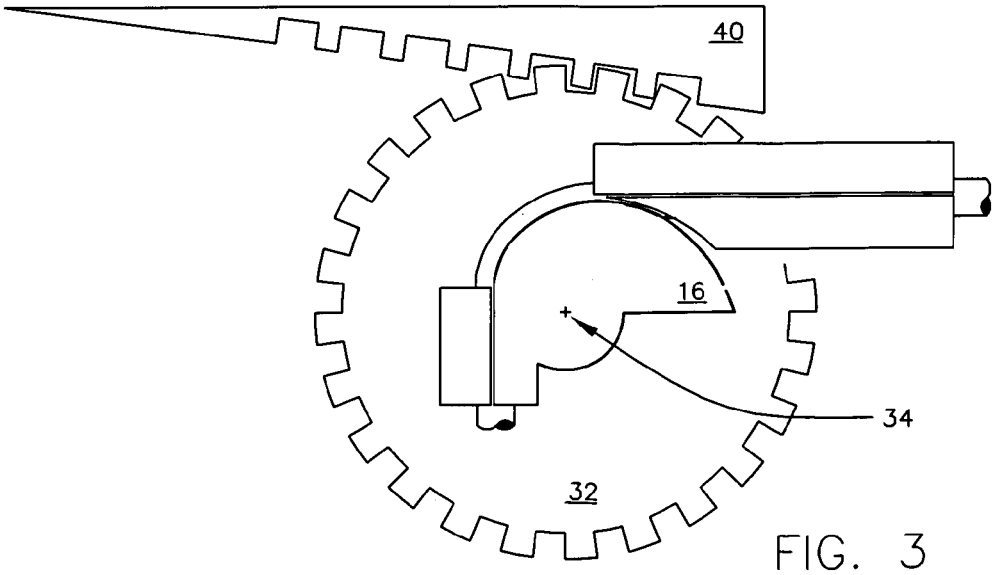
FIG. 3 is a plan view of the bender shown in FIG. 2, particularly illustrating a degree of rotation and the tube in a bent condition.
Figure 4:
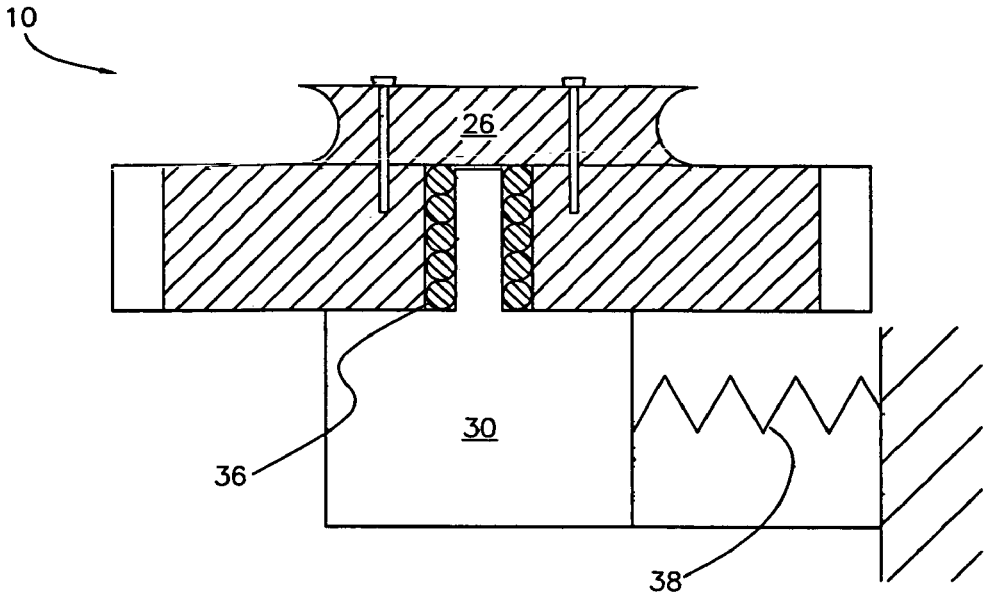
FIG. 4 is a vertical cross section of the bender shown in FIGS. 2 and 3.

In the illustrated embodiment, the apparatus 10 generates a motion of the modified bend die 26 by attaching it to a gear or pinion 32 that forms the pivotable element. More preferably, one of a plurality of modified bend dies of varying curvature is removably connected to the gear 32, as shown in FIG. 4, so as to be easily replaceable by an operator where desired. The gear 32 is pivotably coupled to the structure 30, and pivotable about an axis 34 (see, FIG. 3) within the range of 0° to 360°, and more preferably, approximately equal to 180°. To reduce the frictional energy of rotation, the gear 32 and structure 30 are pivotably coupled via a series of ball bearings 36 as shown in FIG. 4. Alternatively, a solid or fluid lubricant can be utilized in lieu of or addition to the bearings 36 intermediate movable surfaces.

The preferred structure (or base) 30 is constrained to move on a line perpendicular to a line followed by the tube path, so that the bend die 26, gear 32, and structure 30 are linearly translatable. A biasing mechanism, such as the spring 38 shown in FIG. 4 (alternative biasing mechanisms may include pneumatic or hydraulic means), urges the structure 30 towards an initial position shown in FIG. 2.

The apparatus 10 further includes an actuator communicatively coupled to the gear 32 and configured to cause the gear 32 to pivot about an axis 34 and translate. More preferably, a gear rack 40 propelled by a ram (not shown) moves parallel to the incoming tube 12 and engages the gear 32 along an inclined engagement surface 42, so as to force the gear 32 to simultaneously roll on the rack 40 and linearly translate along a line perpendicular to the line followed by the incoming tube 12. Thus, the gear 32 and rack 40 forms a traditional rack and pinion configuration. It is well within the ambit of the present invention, however, to utilize separate actuating mechanisms for causing the element 32 to pivot and the structure 30 to correspondingly translate, and to programmably interconnect the mechanisms.

In the illustrated embodiment, the modified bend die 26 presents a bending surface 44, and a linear clamp surface 46. During bending the clamp surface 46 cooperates with the clamp die to hold a first section of the tube 12 in a fixed position relative to the die 26. The first section of the tube 12 presents a minimum length, $L_1$, sufficient for clamping. Alternatively, where the bend begins at or near a distal end of the tube 12, a conventional clamp plug (not shown) may be utilized. The die 26 is configured to gradually engage the bending surface 44 and a second section of the tube at a fixed pressure point, so that the second section conforms to the curvature of the bending surface 44. To effect the noncircular bending of the tube 12, the bending surface 44 presents a noncircular configuration.

Figure 5:
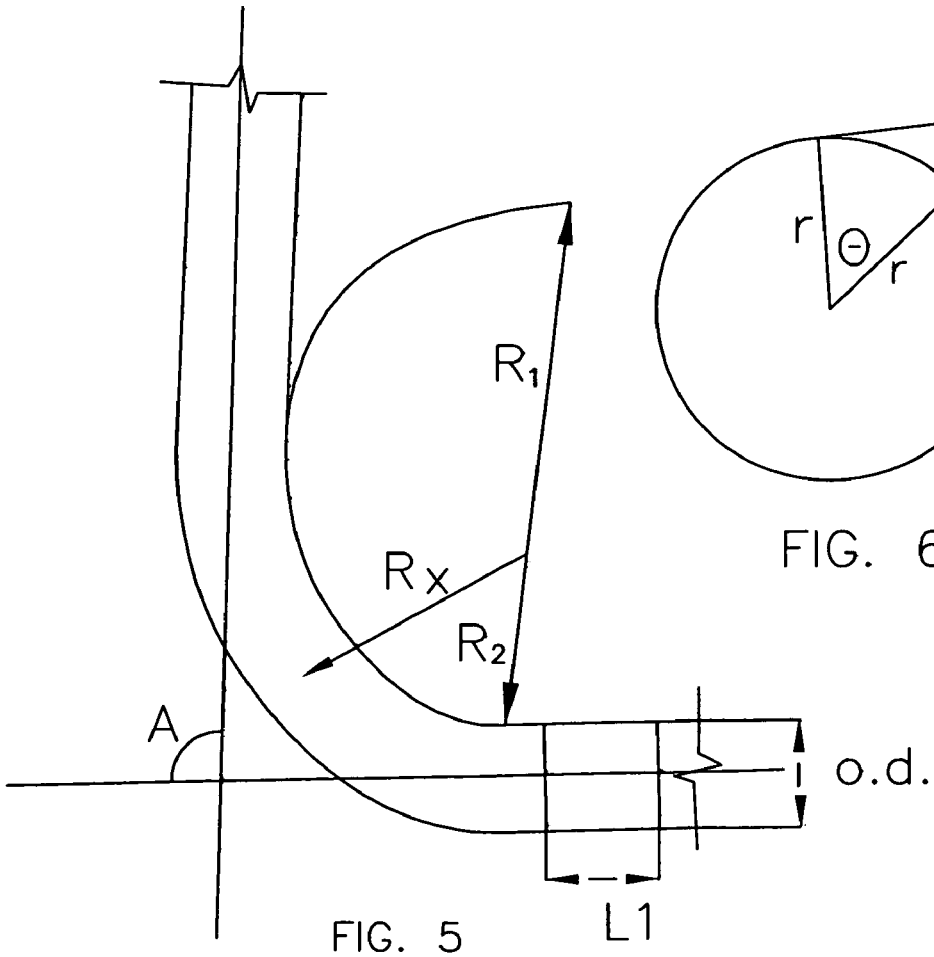
FIG. 5 is a schematic view of the bend die and tube in a bent condition.

More preferably, the surface 44 presents a noncircular, or strict monotonically changing, curve of either linearly or nonlinearly changing radius with respect to the angle of bending. For example, the surface profile may present one or a combination of the group consisting essentially of clothoids, circular involutes, elliptical involutes, semi-parabolic and quarter-elliptical shapes. As shown in FIG. 5, the preferred bending surface 44 presents a minimum radius of curvature, $R_2$, and a maximum radius, $R_1$. As the modified die 26 bends the tube 12, the centerline radius of the bend, $R_x$, as measured from the axis of rotation 34 to the longitudinal axis of the tube 12, increases towards $R_1$. Finally, as previously mentioned, the bend angle, A, has a preferred maximum value of 180°.

Figure 6:
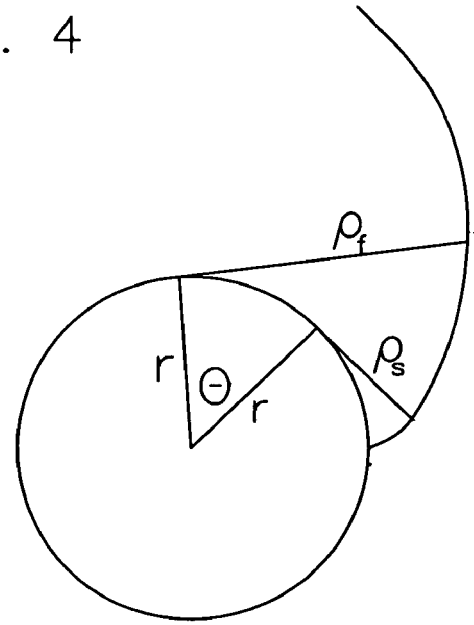
FIG. 6 is a graph of an involute of a circle of radius, r.

Most preferably, the apparatus 10 is configured to bend tubes into a family of shapes that are sections of curves known as circular involutes. As shown in FIG. 6, the involute of a circle can be traced by a point on a thread kept tangent to the circle as it is unwound from the circle. The radius of curvature of an involute grows linearly with the unwound angle around the circle. In other words, the radial difference of the involute between equal sectors of a circle remains the same. Thus, for a circle of radius r, a segment of its involute that has a starting radius of curvature $\rho_o$ will have, after bending through an angle of θ, a final radius of curvature $\rho_f=\rho_o+\theta r$, so that ρ, r and θ determine the shape of the segment.

If the bend surface 44 presents the involute of a circle of radius r=Rsin Φ, where R denotes the radius of the gear 32 greater than r, and Φ equals the angle of the engagement surface 42 of the gear rack 40 with respect to horizontal (See, FIGS. 2 and 3), then the motion of the bend die 26 causes it to meet the tube tangentially at a fixed point in space. It is appreciated that the fixed point of bending allows the pressure die, wiper die and the mechanism that feeds the tube to remain in a relatively fixed position, thereby simplifying construction. Where another non-circular surface profiles is presented, it is further appreciated that a different configuration, including a different shaped horizontal gear rack, would be required to provide the fixed point of contact.

Figure 7:
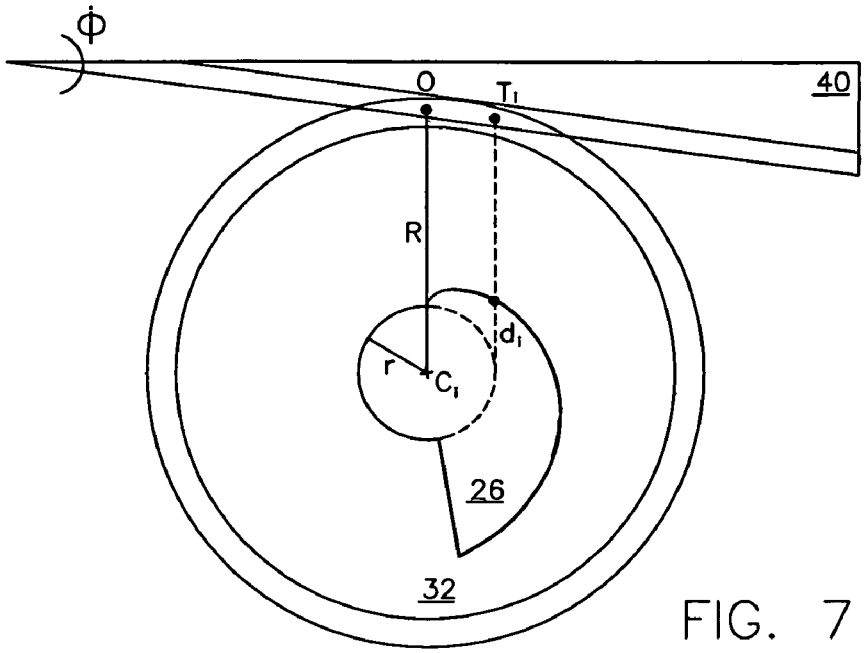
FIG. 7 is a schematic view of the bender shown in FIGS. 2 through 4 at an initial point of bending.
Figure 8:
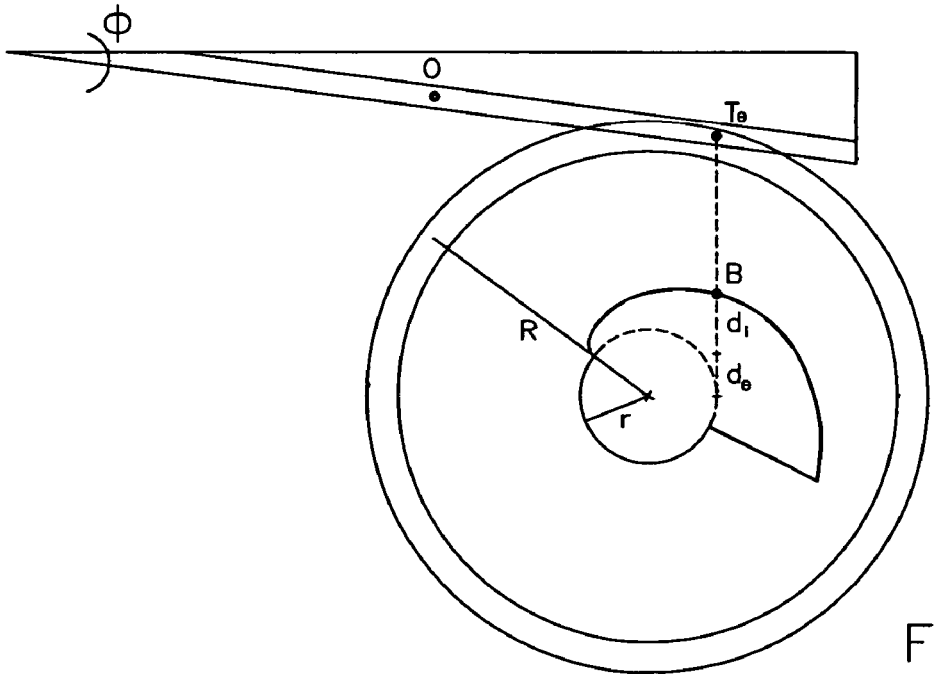
FIG. 8 is a schematic view of the bender shown in FIGS. 2 through 4 at a second point of bending.

More particularly, as shown in FIGS. 7 and 8, however, where R denotes the radius of the circular gear and $C_i$ the initial location of its center, the tangency of the gear rack 40 at $T_i$ and the origin on a line perpendicular to the horizontal linear directional movement of the rack 40 and passing through the center of rotation provide that the center has coordinates:

$$C_i=(0,-R/\cos\Phi).$$

As shown in FIG. 8, the horizontal movement of the gear rack 40 rotates the gear 32 through an angle θ and determines a consequent linear displacement that moves $C_i$ to the new position $C_\theta$ where:

$$C_\theta=C_i+(0,-\theta R\sin\Phi).$$

To ensure that B, the intersection of the vertical line passing through $T_i$ and the involute, remains in a fixed position and still lie on the involute, the additional distance $d_\theta$ along this line from $T_\theta$ to the involute circle must satisfy:

$$\theta r=\theta R\sin\Phi;\ r=R\sin\Phi$$

so that the radius of the involute is determined.

Different segments of the same involute of a circle of radius r can be bent by setting the initial position of the clamp appropriately at the point when the radius of curvature of the involute equals $\rho_o$ and then bending the tube until the desired final curvature $\rho_f$ is reached. To bend an involute from a circle of a different radius r' requires that the bend die 26 be swapped with a new bend die and the engagement surface 42 of the gear racked 40 to be adjusted to an angle Φ' by pivoting the rack about a vertex 48, such that r'=R sin Φ'. Conventional circular arcs can be bent using a circular bend die and setting Φ'=0.

The modified wiper die 28 presents a distal end 50 that is configured to enable the rotation of the bend die 26 while abutting the die near the fixed point of bending. More particularly, the wiper die 28 presents a curved end 50 having a radius of curvature slightly larger than the maximum radius of curvature, $R_1$, presented by the bend die 26. As shown in FIGS. 2 and 3, an increasingly reduced gap between the curvature of the wiper end 50 and the bend die 26 results during bending. The wiper die 28 is sufficiently fixed during bending, so that the gap does not result in instability or create undue stresses in the tip of the wiper end 50. However, since the proximity of the wiper die 28 relative to the fixed point of bending (i.e., the initial contact point between the first section of the tube and the bend die, wherein the bending force is applied and the tube is compressed) determines the efficiency of wrinkle prevention, the gap should be minimized. In this regard, the preferred wiper die 28 includes a vertically adjustable and horizontally retractable internal sleeve **28*a*, as shown in FIGS. 2 and 3, wherein the retractable sleeve 28*a* remains biased towards and in contact with the bend die 26 during bending. Alternatively, the wiper die 28 may be resistively slidable along a limited distance parallel to the tube path, so that the die 28** is gradually displaced as the radius of curvature increases.

Thus, a preferred method of noncircularly bending a tube is described herein, and includes a first step, wherein a vector force, greater than the bending strength of the tube, is applied to a first section of the tube. At a second step, the tube is secured against an engaging surface adjacent to the first section and opposite the vector force direction, so that the first section conforms to the profile of the engaging surface. The preferred surface presents a longitudinal cross section having a noncircular profile of linearly increasing radius of curvature. More preferably, at the second step a second section of the tube is secured in a fixed position relative to the tube engaging surface; the tube engaging surface is fixed to a rotatable and linearly translatable member having a radius equal to R; the member engages an incline surface defining an angle Φ with respect to horizontal, and is rotated and translated by translating the inclined surface perpendicularly to the path of the member. Most preferably, at the second step, the engaging surface defines an involute of a circle having a radius equal to R sin Φ, so as to draw the second section away from the longitudinal axis of the first section and gradually apply the vector force component to the first section at a fixed point in space. At a third step, the second section is released, so that the bent tube can be replaced by a new un-bent tube, and the process repeated.

It is appreciated by those ordinarily skilled in the art that the ability to bend tubes along noncircular curves has the advantage of better accommodation in packaging constraints. Noncircular bends may also provide better structural designs and may allow smoother transitions from bent to straight sections of a tube. This smoother transition further allows better quality in creating attach points should the attached point be optimally located at the transition. Finally, noncircular bends can improve the quality of hydroforming tubes by providing curves with smaller curvatures.

It is further appreciated that the present invention can be utilized in conjunction with various conventional accessories to facilitate the bending process. For example, a Plane of Bend Degree Dial, Model No. DD-996, manufactured by Baileigh Industrial of Manitowoc, Wis., can be utilized for more accurate multi-plane bending. Additionally, a mandrel (not shown) of proper size and material can be conventionally inserted within the tube 12 to facilitate the bending process described herein.

The preferred forms of the invention described above are to be used as illustration only, and should not be utilized in a limiting sense in interpreting the scope of the present invention. Obvious modifications to the exemplary embodiments and modes of operation, as set forth herein, could be readily made by those skilled in the art without departing from the spirit of the present invention. The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. An apparatus adapted for the noncircular bending of a tube, said apparatus comprising:

a holding element engaging a first section of the tube; and a bending element including a bending die having a tube engaging surface, wherein the surface presents a longitudinal cross section having a noncircular circumferential profile, a rotatable member including a gear having a radius equal to R, fixedly connected to the die and configured to cooperatively bend a second section of the tube by rotating the bending die an angular distance, and an actuator including a driven gear rack presenting a lead incline edge defining an angle Φ with respect to horizontal, and communicatively coupled to the member, so as to cause the rotation of the member and die, and the rack and gear are interconnected and cooperatively configured to cause the angular and linear displacement of the gear relative to the rack, said bending and holding elements being cooperatively configured to retain the first section in a fixed position relative to the bending and holding elements, and to bend the second section into a final condition, wherein the second section presents a noncircular bend having a gradually increasing radius of curvature, said bending element being configured to compress the second section of the tube against the surface, so as to conform the second section to the noncircular profile of the surface, said profile defining an involute of a circle concentrically aligned with the gear and having a radius equal to R sinΦ, so that the die engages the tube at a fixed point during bending.

2. The apparatus as claimed in claim 1, said die being removably connected to the rotatable member, and selected from a plurality of removably attachable dies that produce a corresponding plurality of different noncircular bends.

3. The apparatus as claimed in claim 1, said profile defining a segment of a circular involute curve, wherein the arc presents a linearly varying radius of curvature.

4. The apparatus as claimed in claim 1, said profile defining a segment of a clothoid curve.

5. The apparatus as claimed in claim 1, said holding element including a clamp die, said clamp and bending dies being cooperatively configured to clamp the first section in the fixed position.

6. The apparatus as claimed in claim 1, said bending element further including a pressure die, said pressure and bending die being cooperatively configured to apply the bending force to the second section of the tube.

7. The apparatus as claimed in claim 1, said profile presenting a maximum radius of curvature, said holding element including a wiper die presenting a distal end abutting the profile, said end presenting a curvilinear surface having a radius of curvature slightly larger than the maximum radius of curvature of the profile, so as to enable the bending die to rotate and slidably engage the wiper.

8. An apparatus adapted for the noncircular bending of a tube, said apparatus comprising:

a holding element engaging a first section of the tube; and a bending element including a bending die having a tube engaging surface, wherein the surface presents a longitudinal cross section having a noncircular circumferential profile, a rotatable member including a gear, fixedly connected to the die and configured to cooperatively bend a second section of the tube by rotating the bending die an angular distance, and an actuator including a driven gear rack communicatively coupled to the member, so as to cause the rotation of the member and die, and the rack and gear are interconnected and cooperatively configured to cause the angular and linear displacement of the gear relative to the rack, and the gear rack presents a lead incline edge defining an angle and vertex with respect to horizontal, and being pivotable about the vertex so as to adjust the angle, said bending and holding elements being cooperatively configured to retain the first section in a fixed position relative to the bending and holding elements, and to bend the second section into a final condition, wherein the second section presents a noncircular bend having a gradually increasing radius of curvature, said bending element being configured to compress the second section of the tube against the surface, so as to conform the second section to the noncircular profile of the surface.

9. An apparatus adapted for the noncircular bending of a tube, said apparatus comprising:

a holding element engaging a first section of the tube; and a bending element configured to apply a bending force to a second section of the tube, said bending and holding elements being cooperatively configured to retain the first section in a fixed position relative to the bending and holding elements, and to bend the second section into a final condition, wherein the second section presents a noncircular bend having a gradually increasing radius of curvature, said bending element including a bending die having a tube engaging surface, wherein the surface presents a longitudinal cross section having a noncircular circumferential profile, said bending element being further configured to compress the second section of the tube against the surface, so as to conform the second section to the noncircular profile of the surface, said bending element including a rotatable spur gear removably connected to the die, and a driven gear rack interconnected with the gear, and configured to cause the rotation and linear displacement of the gear and die relative to the rack, said gear having a radius equal to R, said gear rack presenting a lead incline edge defining an angle Φ and a vertex with respect to horizontal, and being pivotable about the vertex so as to adjust the angle Φ, said profile defining an involute of a circle concentrically aligned with the gear and presenting a radius equal to RsinED, so that the die engages the tube at a fixed point during bending.

10. A method for noncircularly bending a tube, wherein the tube presents first and second sections, a bending strength, and longitudinal axis, said method comprising the steps of:

a) applying a vector force component greater than the bending strength to the first section; and b) securing a tube engaging surface adjacent the first section and opposite the vector force direction, wherein said surface presents a longitudinal cross section having a noncircular circumferential profile and the profile presents a linearly increasing radius of curvature, securing the second section in a fixed position relative to the tube-engaging surface, steps a) and b) further including the steps of fixing the tube engaging surface to a rotatable and linearly translatable member having a radius equal to R, engaging the member with an incline surface defining an angle Φ with respect to horizontal, rotating and translating the member by translating the inclined surface perpendicularly to the path of the member, and defining an involute of a circle having a radius equal to RsinΦ, so as to draw the second section away from the longitudinal axis of the first section and the inclined surface and gradually apply the vector force component to the first section at a fixed point.

11. The method as claimed in claim 10, said profile defining an involute of a circle.

* * * * *